United States Patent [19]

Steidinger

[11] 4,102,251

[45] Jul. 25, 1978

[54] METHOD OF MAKING A CONTINUOUS ENVELOPE

[75] Inventor: Donald J. Steidinger, Barrington, Ill.

[73] Assignee: Wallace Business Forms, Inc., Hillside, Ill.

[21] Appl. No.: 786,228

[22] Filed: Apr. 11, 1977

Related U.S. Application Data

[63] Continuation-in-part of Ser. No. 696,353, Jun. 15, 1976, abandoned.

[51] Int. Cl.[2] ..... B31B 27/60

[52] U.S. Cl. ..... 93/63 M; 156/226

[58] Field of Search ..... 93/63 M, 63 R, 61 R; 229/69; 156/226, 302, 253, 562

[56] References Cited

U.S. PATENT DOCUMENTS

| | | | |
|---|---|---|---|
| 3,214,083 | 10/1965 | Jory | 229/69 |
| 3,547,343 | 12/1970 | Alton | 229/69 |
| 3,633,816 | 1/1972 | Alton | 93/61 R X |
| 3,988,971 | 11/1976 | Steidinger | 93/63 M |

*Primary Examiner*—James F. Coan

*Attorney, Agent, or Firm*—Tilton, Fallon, Lungmus & Chestnut

[57] ABSTRACT

A method of making continuous envelope structure wherein a continuous ply ultimately constituting the backs of a series of envelopes has united thereto a plurality of ply segments, each ply segment ultimately constituting the front and flap of an envelope in the series, and wherein at least a major portion of the flap of each ply segment overlies the front of an adjacent ply segment, and wherein each ply segment and the continuous ply are transversely perforated after assembly.

6 Claims, 12 Drawing Figures

METHOD OF MAKING A CONTINUOUS ENVELOPE

This is a continuation-in-part of my copending application Ser. No. 696,353 filed Jun. 15, 1976, and now abandoned.

BACKGROUND AND SUMMARY OF INVENTION

This invention relates to a method of making a continuous envelope structure and, more particularly, to one wherein the envelope structure is particularly adapted to be processed through a computer printer.

Increasingly, envelopes are addressed in computer printers programed to utilize lists of selected recipients. Thus, an extensive mailing can be achieved with a minimum of manual labor. Machines and devices are available for stuffing, sealing, etc. the addressed envelopes. A problem has existed in providing the envelopes in a connected series (usually zig-zag folded) whereby they can be stepped through the computer printer at high speed, yet achieve reliable and accurate results. None of the solutions proposed in the art so far fully meet the requirements of reliable operation on the computer or in the insertor or ultimate neat appearance.

These problems have been solved according to the instant invention by utilizing what might be called a "shingling" procedure, i.e., wherein the envelope front plies are discrete and overlapped, one on another, relative to a continuous ply which provides the envelope backs. To this extent, it is somewhat reminiscent of the prior art of U.S. Pat. No. 2,790,593. However, that patent required precision in placing of the front plies in order to obtain a zig-zag foldability and the mandatory neat appearance. Such precision was, and is, practically impossible. For example, if the top ply overlaps the fold line at all, a satisfactory pack cannot be folded — and if the top ply falls short, it exposes the bottom ply and gives a poor appearance.

Therefore, the art has not utilized the "continuous back ply" approach but instead has gone to either continuous front plies or utilized an approach where both plies are continuous. A continuous front ply with a "patch-on" back presents feeding problems on many present day computers. When bot plies are continuous, the openings in the pack present the same feeding problems and also result in large wastage in the back ply, typically 25%.

According to the invention, front plies are assembled on a continuous back ply in overlapped or shingled relation. Thereafter, the front and back plies are simultaneously weakened along transverse lines to develop the lines for zig-zag folding, the means for separating the individual envelopes from the continuous stream and also, if preferred, the line for folding the flap of the envelope into closed position. The stress used to separate the envelopes is not applied however, to the flap fold perforation. Also in the preferred embodiment, control margins are provided in the structure so as to facilitate stepping or indexing of the continuous envelope structure through the computer printer. Other advantages and details of the invention may be seen in the ensuing specification.

DETAILED DESCRIPTION

The invention is described in conjunction with the accompanying drawing, in which FIG. 1 is a fragmentary perspective view of one form of the continuous envelope structure produced in accordance with the invention;

Figure 1:
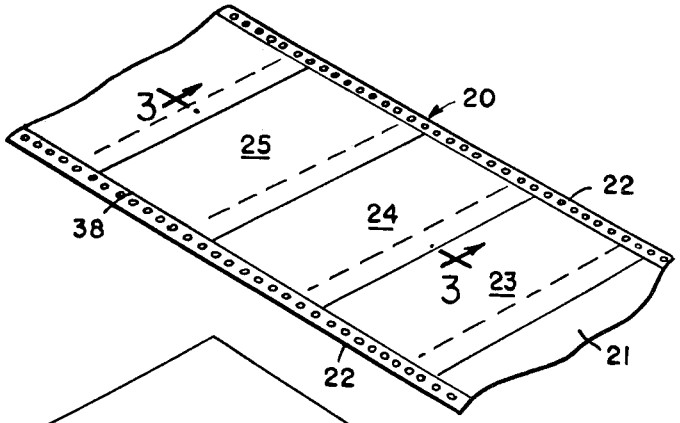
Figure 2:
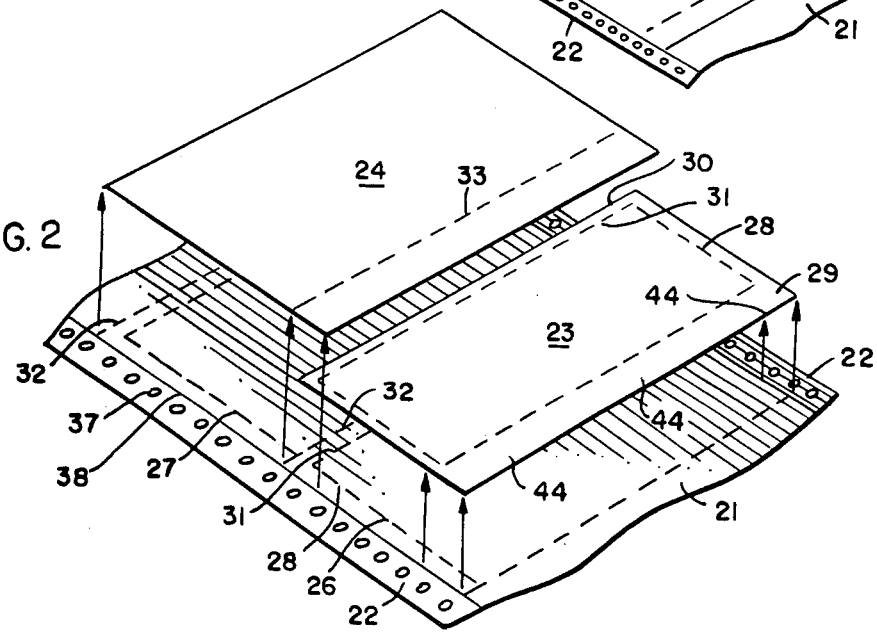
FIG. 2 is an enlarged exploded view of a portion of the form of the invention illustrated in FIG. 1.

Referring now to FIG. 1 of the drawing, the numeral 20 designates generally the continuous envelope structure producible according to the invention. Essentially, the structure 20 includes a continuous ply of web material 21 (usually of paper but not necessarily limited thereto) which, in the embodiment illustrated in FIGS. 1-4, is equipped with control margins 22. In some instances, it may be advantageous to employ only a single control margin although for the purpose of obtaining maximum reliability, two control margins — one along each longitudinal edge of the structure 20, are employed.

United to the continuous ply 21 are a plurality of ply segments 23, 24, 25, etc. The manner of union can be appreciated readily from a consideration of FIG. 2 wherein the continuous ply 21 is seen to be equipped with a series of generally U-shaped bands of adhesive 26, 27, etc., all between the control margins 22 (see also the right hand portion of FIG. 12 where a longitudinally extending leg portion of one of the U-shaped bands is designated 28).

Again referring to FIG 2, it will be seen that the first ply segment 23, for example, is adhered to the bottom ply 21 by the adhesive band 26. The ply segment 23 has a "length" (this dimension referring to the measurement in the direction of the length of the continuous ply 21) greater than the length of the legs 28 of the U-shaped band of adhesive 26 — thereby providing a free portion 29. The free portion 29, in the illustration given in FIGS. 1-4, provides the free portion or flap of the envelope.

The ply segment 23 is secured to the continuous ply 21 adjacent the bottom edge 30 of the segment 23 ("bottom" in terms of the ultimate envelope wherein the flap 29 is usually considered the "top"). This is achieved through the base portion 31 of the U-shaped band of adhesive 26. It will be appreciated that, depending upon the method of manufacture, the adhesive band 26 may be applied to either the continuous web 21 or the ply segment 23.

Adjacent the bottom edge 30 of the ply segment 23, the continuous ply 21 is equipped with a transversely extending line of potential folding and severance 32. In the illustration given, this particular line of potential folding is achieved through perforation so as to also constitute a line of weakness or potential severence whereby the continuous envelopes in the series may be separated into individual envelopes.

Figure 3:
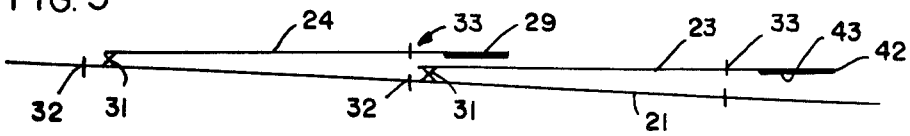
FIG. 3 is an enlarged longitudinal sectional view taken along the sight line 3—3 of FIG. 1.
Figure 4:
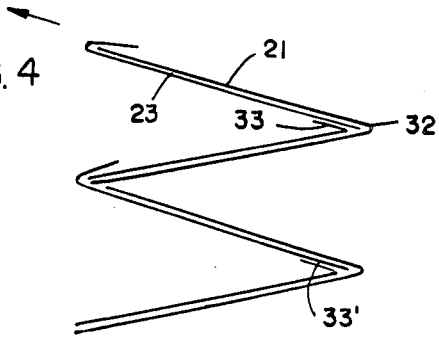
FIG. 4 is a fragmentary, essentially schematic, side elevational view of the form of the invention seen in FIG. 1 but when the same is in zig-zag folded condition.

Aligned with the line of potential folding 32 is a second line of potential folding 33 provided in the ply segment 23 (see particularly FIG. 3). The provision of these lines of potential folding 32 and 33 permits the development of a zig-zag folded arrangement as illustrated in FIG. 4. The lines 32 and 33 are developed simultaneously as will be brought out in greater detail hereinafter relative to FIG. 12. This simultaneous perforation guarantees that the lines 32 and 33 are in perfect alignment.

Referring again to FIG. 3, it will be seen that the flap 29 of the ply segment 24 overlies the bottom portion of the ply segment 23. It is this overlapping arrangement, viz, "shingling," which I have found particularly advantageous in the processing of continuous envelope structures through computer printers. The benefits of the invention are not limited to the form of product illustrated in FIGS. 1–4 but can be realized through a variety of modifications. In any event, however, I utilize a continuous back ply to improve feeding through the various computer printers in present use. This ply can be the full width and include the control punch margins as illustrated in FIGS. 1–4 or can be narrow in relation to the form width. On the other hand, the face or front-providing ply is made up of individually cut pieces. These pieces form the front and flap of the envelope — the flap portion overlapping the front of the adjoining envelope. This top ply can be narrow in relation to the form width as illustrated in FIGS. 1–4 or can be narrow but with a fold under the longitudinal edges so as to develop a somewhat "wider" pocket. This embodiment of the invention is illustrated in FIGS. 5 and 6.

Figure 5:
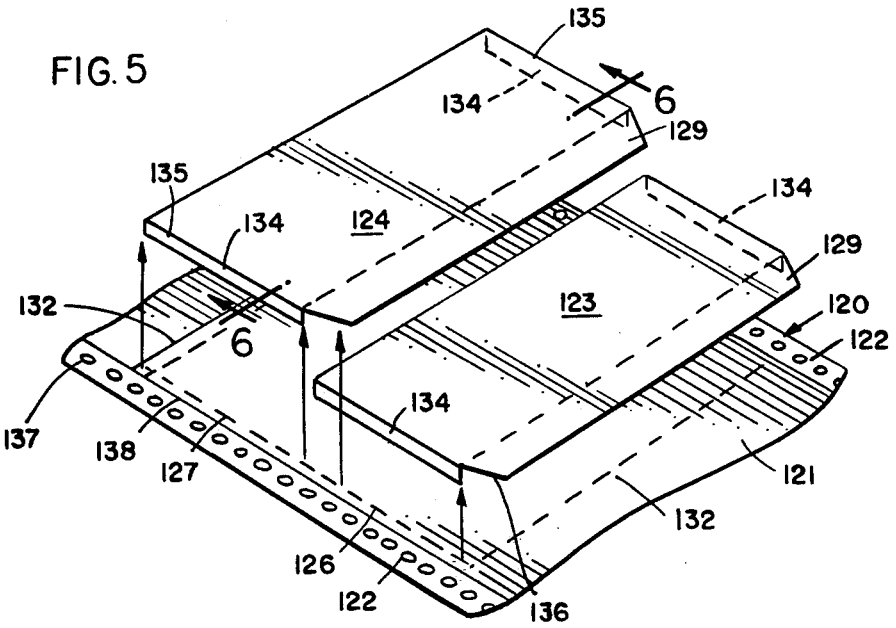
FIG. 5 is a view of the tape seen in FIG. 2, but which shows a slightly different structure which also can be produced in accordance with the invention.
Figure 6:
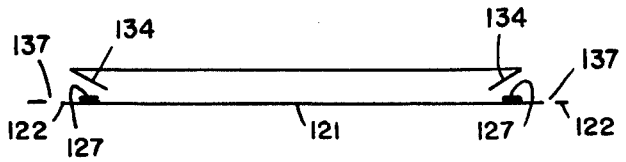
FIG. 6 is a transverse sectional view such as would be seen along the sight line 6—6 applied to FIG. 5.

In FIGS. 5 and 6, the continuous envelope structure is designated generally by the numeral 120 and is essentially similar to that depicted in FIGS. 1–4 with the exception of the provision of a folded under marginal portion 134 along each longitudinal edge 135 of each ply segment 123 and 124. A further difference resides in the shape of the flap 129 which are die-cut as at 136 to result in a beveled, conventional appearance and also improve functioning of the envelopes in inserting machines.

The folded under marginal portions 134 (see FIG. 6) are adhesively united to the continuous ply 121 by the legs 127 of the U-shaped band of adhesive 126. As in the case of the structure illustrated in FIGS. 1–4, the U-shaped band of adhesive 126 is located within the control margins 122. In conventional fashion, these control margins are equipped with line holes 137 (or 37 relative to the showing in FIGS. 1–4). Normally, the margins are defined by longitudinally extending lines of perforation as at 138 or 38, as the case may be, for ease of detachment after the continuous envelope structure has been processed through the computer printer. Also, as was the case of the embodiment of FIGS. 1–4, the individual envelopes are achieved by separating the continuous ply 121 along transverse lines of perforation as 132.

The embodiment of FIGS. 5 and 6 is especially advantageous in providing a somewhat "wider" envelope as well as yielding one that is somewhat easier to open for insertion of mailing material. In the manufacture of the same, the ply segments 123, 124, etc., are prefolded to develop the underfolds 134 and then applied to the continuous ply 121 in the same fashion that the ply segments 23, 24, 25, etc. are applied to the continuous ply 21.

Figure 7:
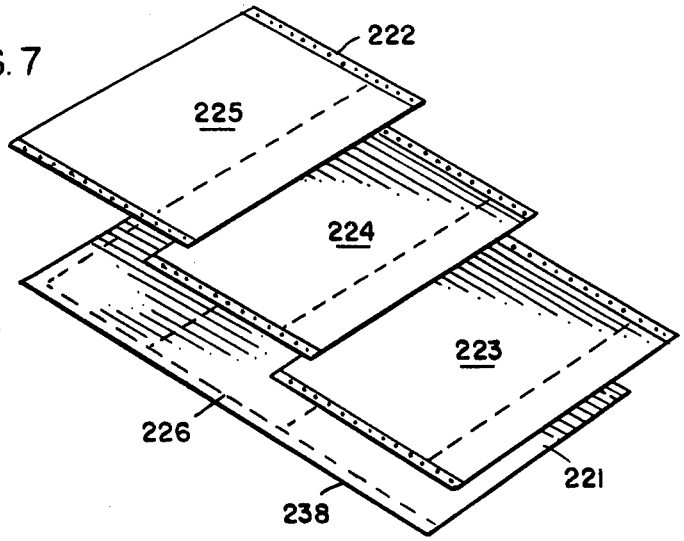
FIG. 7 is an exploded perspective view of still another structure which can be made according to the instant invention.

A further variation of the invention is possible in terms of the width of the continuous ply and ply segments. As illustrated in FIGS. 1–6, the ply segments constituting the top or front ply of the envelope is narrow in relation to the form width. In FIG. 7, the variation is seen wherein the ply segments 223, 224, 225, etc. are wider, i.e., being of full width and including the control punch margins 222. In such an instance, the continuous ply 221 is narrow, i.e., having its side edges 238 lying within the control margins 222. However, a similar width envelope is developed inasmuch as the U-shaped bands of adhesive 226 occupy the same position relative to each other on the continuous ply 221 in the FIG. 7 embodiment as they do in the preceding embodiments — except for the fact that they are along the edges rather than adjacent the control margins (which are omitted from the bottom ply 221).

Figure 8:
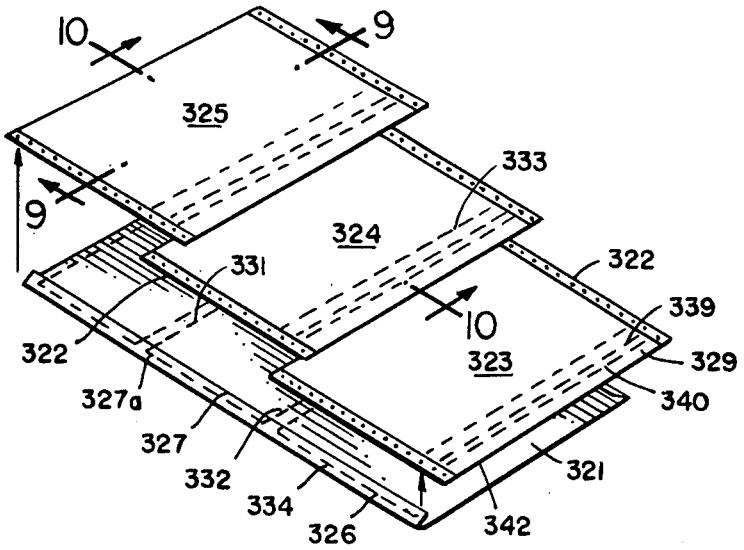
FIG. 8 is an exploded perspective view of yet another structure producible according to the invention.
Figure 9:
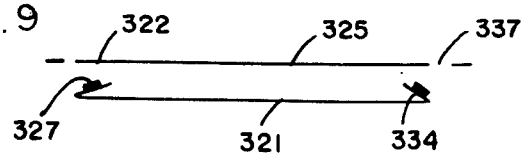
FIG. 9 is a sectional view taken along the line 9—9 of FIG. 8.
Figure 10:
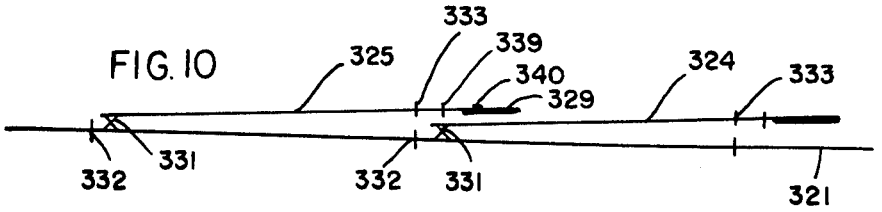
FIG. 10 is a longitudinal sectional view taken along the line 10—10 of FIG. 8.

Turning now to the third drawing sheet and, in particular, to the illustration of the invention in FIGS. 8–10, it will be seen that again the ply segments 323, 324, 325, etc. are wider than the continuous ply 321. The ply 321 is equipped with folded over marginal portions as at 334 which fit within the usual control margins 322. Again, the control margins are equipped with the usual line holes as at 337. Again, a generally U-shaped band of adhesive 326 is employed to secure the continuous ply 321 to the various ply segments 323, 324, 325, etc. The longitudinally extending legs 327 of the U-shaped band of adhesive are provided on the over folded marginal portions (see FIG. 9). At the base ends of the U-shaped band of adhesive as at **327*a* (see FIG. 8), the bands of adhesive line up with the base portion 331. As before, the base portion 331 of the band of adhesive 326 is positioned adjacent the transverse line of perforation 332. These are indicated schematically in FIG. 10 by vertical bars intersecting the continuous ply 321**.

As in the case of the embodiments previously described, each of the ply segments 323, 324, 325, etc., is equipped with a line of potential folding as at 333. This permits the continuous envelope structure to be folded in the fashion shown in FIG. 4, i.e., the line 333 is a pack fold line. In this embodiment, however, the line of potential folding 333 is not employed to fold the flap 329 for sealing the envelope and its contents, i.e., it is not the flap fold line. For that purpose, a second line of potential folding 339 is provided in the various ply segments 323, etc. This structural variation improves the envelope function and appearance — by providing the flap fold line 339 a short distance (of the order of $\frac{1}{8}$ inch (3 mm) to $\frac{1}{2}$ inch (13 mm)) above the pack fold line 333. The $\frac{1}{8}$ inch is adequate to get the top of the back edge down from the flap fold for improved inserting but $\frac{3}{8}$ inch (9 mm) to $\frac{1}{2}$ inch (13 mm) is preferred for a reasonably sized tear-off strip. This short distance between the flap fold and the upper edge of the envelope back (as ultimately developed at line 332 — see FIG. 10) is an advantageous feature for automatic inserting machinery.

Further, in certain instances it may be advantageous to introduce another line of potential severance as at 340 which, in combination with the line of potential folding 333 can be employed as a "tear to open" strip at the top of the envelope. In such a case, the line of potential folding 333 is also a line of weakness or perforation so that the lines 333 and 340 together define a strip which enables ready opening of the ultimately sealed envelope — in this case the distance between lines 333 and 339 is of the order of ¼ inch (6 mm) to ½ inch (13 mm) (and the distance between lines 339 and 340 is equal to the distance between lines 333 and 339).

Figure 11:
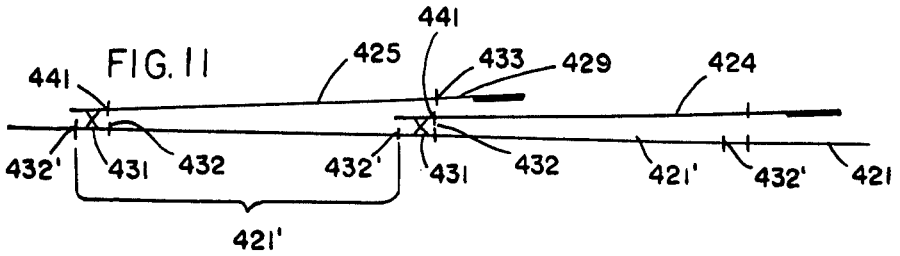
FIG. 11 is a longitudinal sectional view, essentially of the nature seen in FIG. 10 but featuring a further modification.

A still further variation of the "tear to open" feature is illustrated in FIG. 11. There, the continuous ply is designated by the numeral 421 and is seen to have united thereto, in the manner previously illustrated, ply segments 424 and 425. A portion of the uniting adhesive is designated by the numeral 431 but in the embodiment of FIG. 11 it will be seen that the lines of potential folding as at 432 and 433 are above (relative to the ultimate individual envelope) the base of the band of adhesive 431. However, as in the embodiments of FIGS. 1–7, the line of potential folding 433 defines the lower edge of the envelope flap 429.

Although the line of potential folding 432 is a line of weakness or perforation to permit ultimate separation of the web 421, the initial separation of that web is achieved along line of perforation 432'. Thus, in the operation of the continuous structure of FIG. 11, after the continuous structure has been processed through the computer printer, individual envelopes are achieved by separation of the continuous ply 421 along the transverse lines of perforation 432'. After this has been achieved, the individual envelopes can be stuffed, sealed, and mailed — and when received by the recipient, provide a bottom openable envelope. For this purpose, the bottom of the envelope front is equipped with a line of weakness or perforation as at 441. Thus, the recipient merely needs to grasp the bottom edge of the envelope to remove a minor portion therefrom. This first includes the bottom of the front ply segment as at 424, 425, etc. Further, it includes the bottom portion of the back panel 421' — this being one of identical backs resulting from the separation of the envelopes from the continuous stream by transverse severance of the web 421 along the lines 432'. The purpose of the FIG. 11 structure is to provide a means where the bottom of the front ply can extend below the bottom of the back ply to give an improved appearance to the face of the envelope. The tear strip at the bottom makes advantageous use to the "extra" perforation 441 used for folding the pack.

From the foregoing, it will be seen that there is a wide range of variations possible while still utilizing the advantageous overlapping or shingling of the flap of one envelope relative to the bottom of the front of an adjacent envelope and thereafter perforating the assembly. Normally, the flap 29, 129, etc., is defined as that portion of the ply segment 23, 24, etc., which extends between the free edge 42 (see FIG. 3) of the ply segment 23 and the line of potential folding 33. This substantially overlaps the bottom portion of the next adjacent ply segment. However, where the flap is defined by the portion of the ply segment 323 between the free edge 342 (see FIG. 8) and the flap fold line 339, all of the flap 329 overlies the bottom portion of the ply segment 324. In any event, at least a major portion of the flap of the ultimate envelope overlies the adjacent ply segment.

The term "line of potential folding" as used herein contemplates a variety of structures productive of the resultant, desired folding. For example, a score line is used to advantage where only folding is contemplated — exclusive of ultimate severance. The score line may be achieved through a line of ink (as by printing) coupled with the legend "fold along this line." In some instances, the line of weakness may include score lines, weak or strong perforations, depending upon the intended usage. All of the foregoing are advantageously achievable during the process of manufacture of the continuous envelope structure. Normally the continuous ply serves as the carrier as by being advanced along a predetermined path. Thereafter, the ply segments 23, 24, 25, etc., are laid down serially to be united with the continuous ply 21. Depending upon the particular form of ultimate envelope desired, the uniting is achieved by applying adhesive either to the continuous web 21 or the ply segments 23, etc. The flap adhesive 43 (see FIG. 3) is applicable to the ply segments either prior to union with the continuous ply 21 or after ply separation to derive individual envelopes.

In some instances, it may be advantageous to use small spots of adhesive to hold the flap in position against the face of the adjacent front to avoid any possible difficulty in feeding the computer. Thus, for example, small dots of adhesive as at 44 (see FIG. 2) may be applied to the underside of the flap portion 29 so as to insure that the flap 29 does not upstand or fold improperly during the feeding of the continuous structure to the computer. In a folded pack (see FIG. 4) some flaps (as at 33') would be folded in the opposite way from their eventual use which would cause them to tend to stand up away from the adjacent envelope front when going through the computer. Such small spots of glue as at 44 are readily broken loose in the bursting operation. Inasmuch as the spots of adhesive 44 are in the same area as the band of adhesive 43, the same can be achieved from selective moistening of the adhesive or otherwise activating the same in small selected areas.

Figure 12:
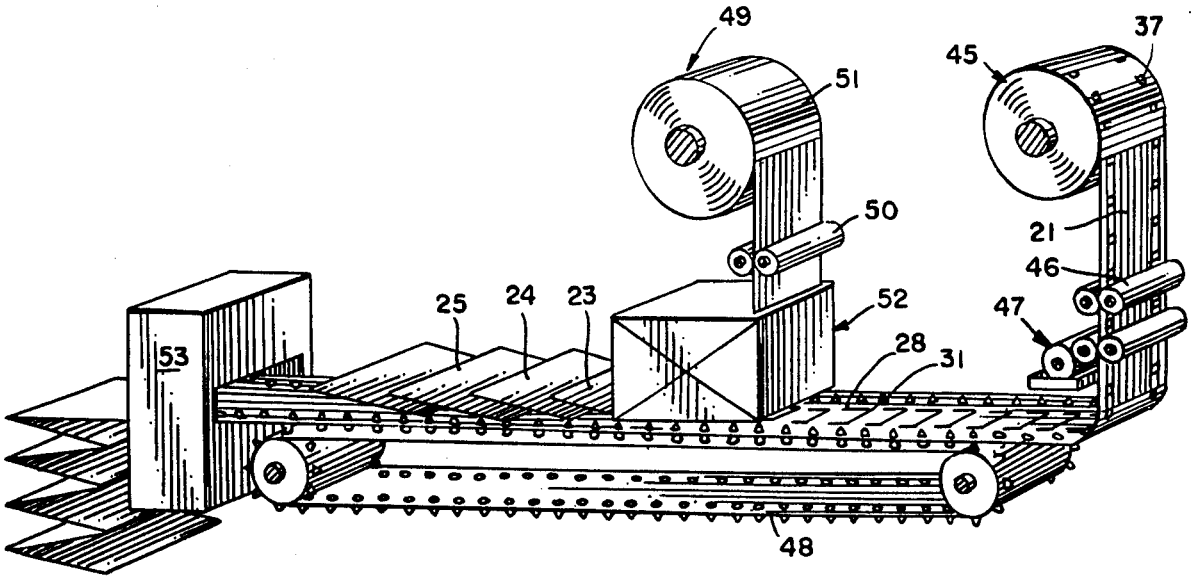
FIG. 12 is a schematic view generally in perspective form showing apparatus employed in the practice of the method of the invention.

The method of preparing the inventive continuous envelope assembly can be better understood from a consideration of FIG. 12. There, the numeral 45 designates generally a parent roll which provides the bottom or continuous web 21. The web 21 is advanced from the usual spindle-equipped stand (not shown) through feed rollers 46 and is equipped with a pattern of glue via the adhesive applicator system generally designated 47. Thereafter, the web 21 is controlled to advance along a predetermined path by means of a pin belt 48. It will be appreciated that the equipment is depicted in FIG. 12 in essentially schematic form for ease of picturing and understanding — such machine elements as idlers and the like being omitted.

The source of the ply segments 23, 24, 25, etc. is another parent roll generally designated 49. The web emanating from the roll 49 is advanced by means of feed rolls 50 at a somewhat higher speed than the web 21. In some instances it may be advantageous to eliminate the feed rolls 46 and merely rely upon the force exerted by the pin belt system 48 to advance the web 21 and unwind the same from the parent roll 45. The faster unwinding of the parent roll 49 permits the development of the overlapping or shingled arrangement of the ply segments constituting the fronts and flaps of the various envelopes. Incident to the unwinding of the parent roll 49 and prior to the application of the web segments 23, 24, 25, etc., to the cointinuous web 21, the web 51 is transversely severed by means of the cutoff and positioning device generally designated 52.

In the specific illustration given in FIG. 12, the web 21 is equipped with the control margins 22 having therein the line holes 37. These are advantageously provided in the press (not shown) which precedes the winding of the web into the parent roll 45.

Also, advantageously performable prior to the operation depicted in FIG. 12 is the provision of the transverse band of adhesive 43 (see FIG. 3). This may be provided on the parent roll 49 at the time that the same was printed and otherwise processed prior to being wound into the roll 49. For example, remoistenable glue can be provided on the parent roll at the time of printing on a press, just prior to the time of assembly on the apparatus of FIG. 12, or after separation into individual envelopes.

As the web 21 advances past the cutoff and positioning mechanism 52, the various ply segments 23, 24, etc., are placed in proper position on the web 21 and urged thereagainst so as to engage the pattern of adhesive laid down by the adhesive applying means 47. Thereafter, the continuous structure is advanced through a cross perforator 53 which provides the lines of perforation 32 and lines of potential folding 33. In the mechanism shown in FIG. 12, therefore, the lines of potential folding 33 are, in fact, lines of perforation.

The merit of the arrangement pictured in FIG. 12 is that the lines of perforation 32 and the lines of potential folding 33 can be introduced simultaneously so as to avoid any problem of misalignment. If the two were introduced prior to combination of the webs 31 and 51, a problem of proper alignment will arise. No longer is there any need to carefully align the fold line 33 with the severance line 32 — even a misalignment of less than 1/64 inch (about 0.4 mm) will result in a zig-zag folded pack unacceptable to the trade today. This can be readily appreciated from the situation where the fold line 33 is slightly below the severance line 32 — in such a case it is not possible to fold the flap on the fold line to close the envelope.

In the case of the embodiments of FIGS. 10 and 11, the additional lines of folding or severance can be introduced separately into the webs 21 or 51 and with stronger or weaker bonds depending on whether the lines are to be used for folding or severance.

While in the foregoing specification a detailed description of the invention has been set down for the purpose of illustration, many variations in the details hereingiven may be made by those skilled in the art without departing from the spirit and scope of the invention.

I claim:

1. A method of continuous envelope structure manufacture comprising the steps of advancing a continuous web along a predetermined path, uniting thereto a plurality of ply segments to form a continuous ply, each ply segment having a bottom edge and a top edge extending transversely of the length of said continuous ply with the top edge being free of union with said continuous ply to provide an envelope flap, said ply segments being positioned relative to said continuous ply incident to union thereof to overlap the top edge of one segment relative to the bottom edge of an adjacent segment, simultaneously perforating the united ply segments and continuous web along a transverse line adjacent each segment bottom edge to develop lines of potential severance in said continuous web, and zig-zag folding the united ply segments and continuous web along said transverse lines.

2. The method of caim 1 in which each segment prior to union is equipped with a transverse line of folding spaced from said transverse line of perforation in the direction of said top edge.

3. A method of continuous envelope structure manufacture comprising the steps of advancing a continuous web along a predetermined path, uniting thereto a plurality of ply segments to form a continuous ply, each ply segment having a bottom edge and a top edge extending transversely of the length of said continuous ply with the top edge being free of union with said continuous ply to provide an envelope flap, said ply segments being positioned relative to said continuous ply incident to union thereof to overlap the top edge of one segment relative to the bottom edge of an adjacent segment, said transverse line in each segment additionally constituting a flap fold line.

4. A method of continuous envelope structure manufacture comprising the steps of advancing a continuous web along a predetermined path, uniting thereto a plurality of ply segments to form a continuous ply, each ply segment having a bottom edge and a top edge extending transversely of the length of said continuous ply with the top edge being free of union with said continuous ply to provide an envelope flap, said ply segments being positioned relative to said continuous ply incident to union thereof to overlap the top edge of one segment relative to the bottom edge of an adjacent segment, each segment prior to union being equipped with a transverse line of folding spaced from said transverse line of perforation in the direction of said top edge, said transverse line of folding being also a line of potential severance, each segment being equipped with a second line of potential severance positioned between the transverse line of folding and said top edge to provide a tear-off strip in the envelope flap.

5. A method of continuous envelope structure manufacture comprising the steps of advancing a continuous web along a predetermined path, uniting thereto a plurality of ply segments to form a continuous ply, each ply segment having a bottom edge and a top edge extending transversely of the length of said continuous ply with the top edge being free of union with said continuous ply to provide an envelope flap, said ply segments being positioned relative to said continuous ply incident to union thereof to overlap the top edge of one segment relative to the bottom edge of an adjacent segment, said continuous web prior to union being equipped with a plurality of spaced apart transverse lines of perforation, the bottom edges of said segments being positioned adjacent said plurality of lines whereby discrete envelopes can be separated from the continuous structure along said plurality of lines and said envelopes opened by recipients along said lines of perforation.

6. A method of continuous envelope structure manufacture comprising the steps of advancing a continuous web along a predetermined path, uniting thereto a plurality of ply segments to form a continuous ply, each ply segment having a bottom edge and a top edge extending transversely of the length of said continuous ply with the top edge being free of union with said continuous ply to provide an envelope flap, said ply segments being positioned relative to said continuous ply incident to union thereof to overlap the top edge of one segment relative to the bottom edge of an adjacent segment, simultaneously perforating the united ply segments and continuous web along a transverse line adjacent each segment bottom edge to develop lines of potential severance in said continuous web, and zig-zag folding the united ply segments and continuous web along said transverse lines, one of said continuous web and plurality of ply segments being equipped with a continuous control margin defined by a margin line, the other of said continuous web and plurality of ply segments being longitudinally folded along fold lines adjacent the longitudinal edges thereof to provide marginal folds, said marginal folds of said other being united to said one with said margin and fold lines being generally superposed to provide an envelope with an inside dimension essentially equal to the outside dimension thereof.

* * * * *